US005970158A

United States Patent [19]

Beltran

[11] Patent Number: 5,970,158

[45] Date of Patent: Oct. 19, 1999

[54] COMPACT HORN SPEAKER

[75] Inventor: Carlos I. Beltran, Chicago, Ill.

[73] Assignee: Federal Signal Corporation, University Park, Ill.

[21] Appl. No.: 08/902,841

[22] Filed: Jul. 30, 1997

[51] Int. Cl.[6] ..... H04R 25/00

[52] U.S. Cl. ..... 381/341; 381/343; 381/397

[58] Field of Search ..... 381/340, 341, 381/342, 343, 397, 396, FOR 143; 181/148, 152, 153, 155, 192, 193, 194, 199

[56] References Cited

U.S. PATENT DOCUMENTS

| | | | |
|---|---|---|---|
| 3,991,286 | 11/1976 | Henricksen . | |
| 4,550,229 | 10/1985 | Hwang | 381/340 |
| 4,790,020 | 12/1988 | Lin . | |
| 4,893,343 | 1/1990 | Bader . | |
| 5,397,866 | 3/1995 | Lyons et al. . | |
| 5,637,840 | 6/1997 | Kim | 181/152 |

FOREIGN PATENT DOCUMENTS

| | | | |
|---|---|---|---|
| 2 122 841 | 1/1984 | United Kingdom | H04R 9/06 |

*Primary Examiner*—Huyen Le
*Attorney, Agent, or Firm*—Leydig, Voit & Mayer, Ltd.

[57] ABSTRACT

A compact horn speaker suitable for use on emergency vehicles has a rear-facing motor circuit, a horn plate, and a mouth section. The horn plate has a plurality of horns folded therein in a plane perpendicular to the longitudinal direction of the speaker. The phase plug for the motor circuit is integrally formed on the horn plate and has a plurality of apertures each opening to a folded horn in the horn plate. The folded horns are connected to a horn mouth formed in the mouth section. The mouth section is formed of a thermally conductive material and has an integrally formed receptacle for receiving the magnet assembly of the motor circuit. The receptacle holds the motor circuit firmly in position and provides efficient thermal dissipation via the horn structure for heat generated by the motor circuit during operation.

6 Claims, 6 Drawing Sheets

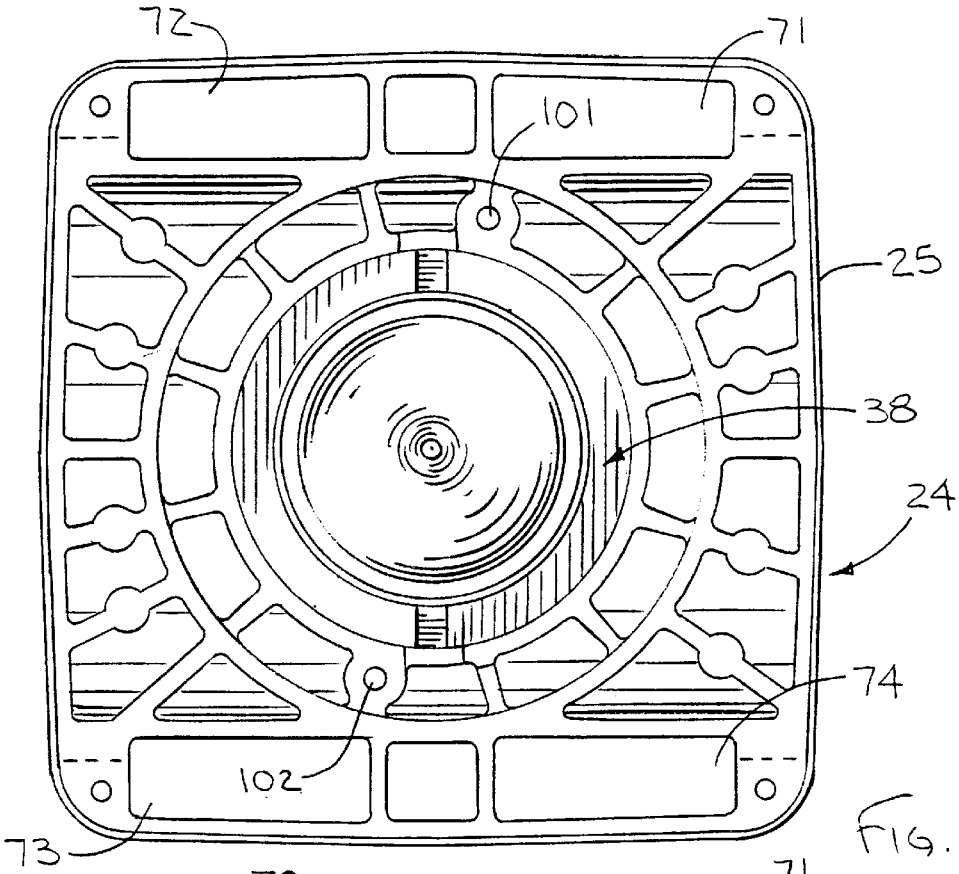
FIG. 6A
FIG. 6B
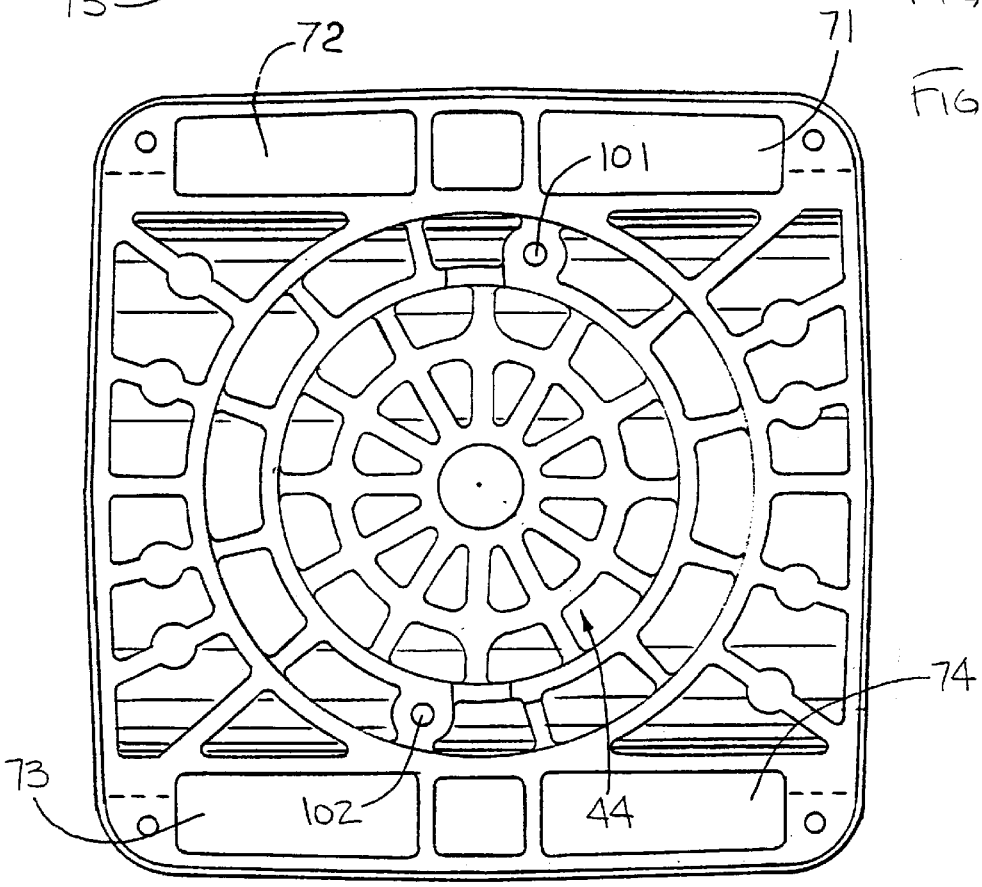

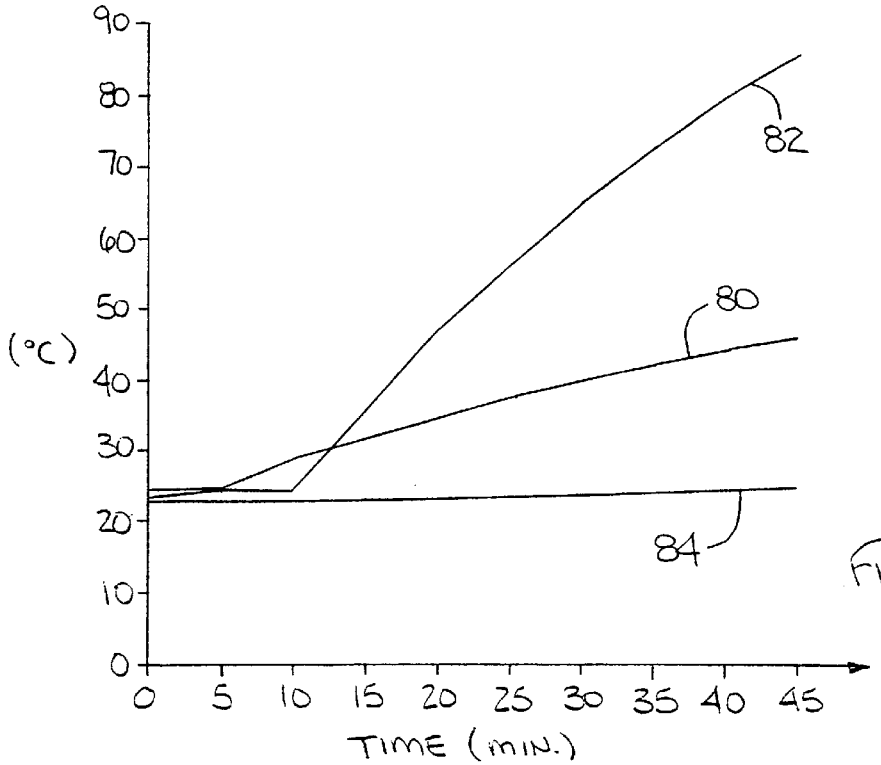
FIG. 7
FIG. 8
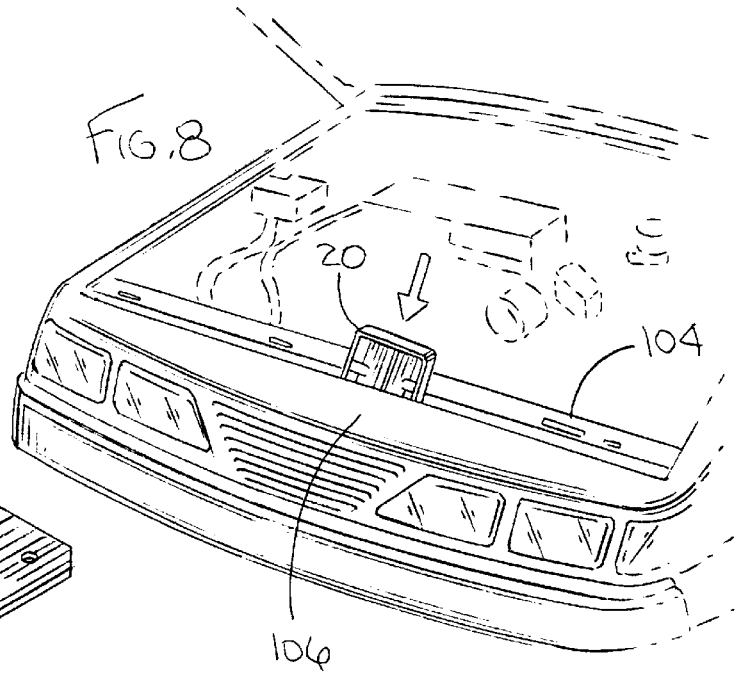
FIG. 9
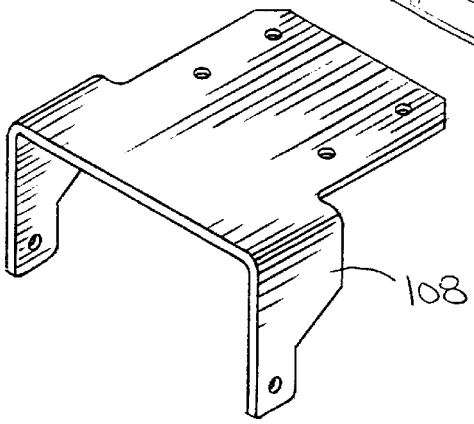

COMPACT HORN SPEAKER

FIELD OF THE INVENTION

This invention relates generally to speakers for generating audio signals, and more particularly to horn-loaded speakers suitable for use on emergency vehicles.

BACKGROUND OF THE INVENTION

Many emergency vehicles are equipped with siren speakers for generating audio emergency warning signals. Such speakers are typically horn-loaded to enhance their efficiencies of sound generation.

One major disadvantage of conventional horn-loaded speakers is that they are typically very bulky, due to the horn length required to provide efficient coupling of acoustic energy to the external air. It is common to fold the horn structure of a horn-loaded speaker to reduce the overall length of the speaker. Nevertheless, even with a folded horn structure, a horn speaker still tends to be large and heavy.

The bulkiness of horn speakers makes their proper placement very difficult in many applications. This problem is especially serious for siren speakers designed for use on emergency vehicles. This is because siren speakers are typically add-on items to emergency vehicles, and it is often very difficult to find adequate space in an emergency vehicle to accommodate a horn-loaded siren speaker.

A significant progress in the reduction of the overall size of a horn-loaded siren speaker was made in a speaker disclosed in U.S. Pat. No. 4,893,343. This speaker has a conventional driver positioned to face the rearward direction of the speaker and a horn folded around the driver. The first section of the horn is formed in a horn plate which is disposed perpendicular to the longitudinal axis of the speaker. The driver is positioned in register with a central aperture in a horn plate which opens to the horn in the horn plate and forms the throat of the horn. The horn is bifurcated twice in the horn plate to form four passage ways. The speaker further includes a horn housing in which the driver is mounted. A dome-shaped cap is attached to the end of the driver assembly. The side walls of the housing and the surface of the dome cap define a horn mouth facing the forward direction of the speaker. The horn mouth is coupled to the passage ways in the horn plate for coupling the acoustic energy conducted therethrough to the external air.

The folding of the horn in the horn plate and around the driver results in a significant reduction of the length of the speaker. Nevertheless, even with the size reduction achieved with this construction, the length and weight of this speaker is still quite substantial. As a result, it is often hard to find an adequately sheltered location in an emergency vehicle for mounting the speaker. It is common to mount the speaker under the front bumper of an emergency vehicle. At such a location, the direct exposure to rain, wind, and dust significantly shortens the service life of the speaker.

Another common problem of horn-loaded siren speakers used on emergency vehicles is related to the cooling of the driver. A siren speaker used on an emergency vehicle is required to be capable of generating a very high sound level. During high-power operation, the heat generated in the voice coil and the magnet assembly of the driver has to be efficiently dissipated away. Accumulated heat in the driver can cause a loss of efficiency and in some cases may even cause the voice coil to be burned out or reduce the magnetic strength of the magnet assembly. Efficient heat dissipation, however, is difficult to achieve, especially in a design that tightly folds the horn structure about the driver to achieve a compact size. It is possible to use active means, such as a fan, to force air circulation around the magnet assembly. Such powered cooling, however, is undesirable due to the added power consumption, complexity, and cost of the speaker.

SUMMARY OF THE INVENTION

In view of the foregoing, it is a primary object of the invention to provide a horn speaker suitable for use on an emergency vehicle that is substantially more compact and lighter than existing horn-loaded siren speakers such that it provides significantly improved flexibility in placement.

It is a related object of the invention to provide a compact horn speaker that provides efficient cooling for the sound-generating components without the use of active air circulation components.

It is another related object of the invention to provide a compact horn speaker that has a simple and robust structure that is easy to manufacture and assemble.

In accordance with these and other objects of the invention, there is provided a horn speaker that is significantly more compact than existing horn speakers of comparable acoustic output capacity. The speaker of the invention includes a motor circuit coupled to a horn folded around the motor circuit. The motor circuit includes a magnet assembly, a moving diaphragm, and a voice coil attached to the moving diaphragm. The horn structure of the speaker includes a horn plate and a mouth section. The horn plate has at least one horn folded in the plane of the horn plate. The phase plug for the motor circuit is integrally formed on the horn plate. The phase plug has at least one aperture opening to the folded horn in the horn plate and thus forms the throat of the horn. The mouth section has a horn mouth connected to the folded horn in the horn plate for coupling sound waves to the external air.

In one preferred embodiment, the mouth section has a unitary body formed of thermally conducted material, such as aluminum. The front side of the unitary body is shaped into a horn mouth which is connected to the folded horns in the horn plate. The rear side of the unitary body of the mouth section has an integrally formed receptacle for receiving the magnet assembly of the motor circuit. The receptacle is sized to match the magnet assembly to provide thermal transfer between the magnet assembly and the mouth section. The unitary body of the mouth section functions as a heat sink to efficiently dissipate the heat generated by the motor circuit during operation.

Other objects and advantages will become apparent with reference to the following detailed description when taken in conjunction with the drawings in which:

BRIEF DESCRIPTION OF THE DRAWINGS

FIG. 6A is a rear elevational view of a mouth section of the speaker of FIG. 1 with a magnet assembly fitted therein;

FIG. 6B is a rear elevational view of the mouth section similar to FIG. 6A but without the magnet assembly;

FIG. 7 is a chart showing operating temperature data of motor circuits with and without heat sinking provided by the mouth section of FIG. 6A;

FIG. 8 is a schematic diagram illustrating a possible location in a vehicle for installing the compact horn speaker of the FIG. 1;

FIG. 9 is a perspective view of a mounting bracket for mounting the speaker of FIG. 1 in a vehicle.

Figure 1:
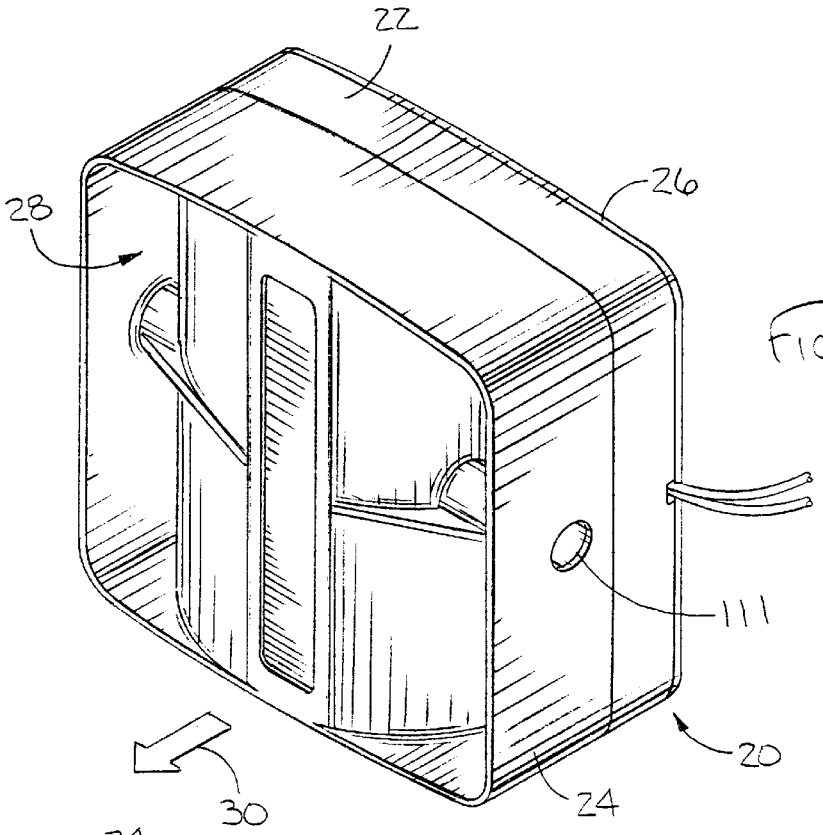
FIG. 1 is a perspective view of a compact horn speaker embodying the invention.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the invention is to cover all modifications, alternative constructions and equivalents falling within the spirit and scope of the invention as defined by the appended claims.

DETAILED DESCRIPTION OF THE PREFERRED EMBODIMENT

Figure 2:
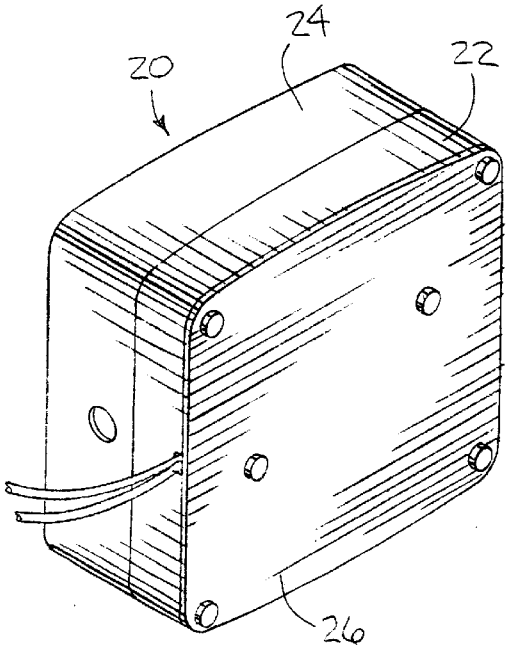
FIG. 2 is a perspective view showing the back side of the speaker of FIG. 1.

Turning now to the drawings, FIG. 1 shows a preferred embodiment of a compact horn speaker 20 constructed according to the invention. The speaker 20 has a motor circuit 36 (FIG. 3) and a horn structure which is folded around the motor circuit and completely encloses the motor circuit. As illustrated in FIG. 1, the speaker 20 has a generally square peripheral shape and includes a horn plate 22, a mouth section 24, and an end plate 26. The front of the mouth section is shaped into a horn mouth 28 for coupling acoustic energy generated by the speaker to ambient air. The front direction as indicated by the arrow 30 refers to the general transmission axis of the sound generated by the speaker. As shown in FIG. 2, the rear side of the speaker 20 is terminated by the end plate 26. The end plate 26 cooperates with the horn plate 22 to define folded horns formed in the horn plate. A gasket may be inserted between the end plate 26 and the horn plate 22 to prevent air leakage. In the illustrated embodiment, the dimension of the sides of the generally square horn mouth 28 is about 5.75 inches. The overall length of the speaker, i.e., the distance between the end plate 26 and the front end of the mouth section 24, is about 2.63 inches.

It can immediately be appreciated by those skilled in the art that the horn speaker 20 is significantly more compact than existing horn-loaded siren speakers of comparable acoustic output capacity. For instance, the prior art speaker disclosed in U.S. Pat. No. 4,893,343 with a similar mouth size would have an over-all length of about 5.25 inches, which is twice of that of the speaker 20 constructed according to the invention. The drastic length reduction of the horn speaker of the invention is achieved by integrating the structure of the motor circuit with the structure of the folded horn.

Figure 3:
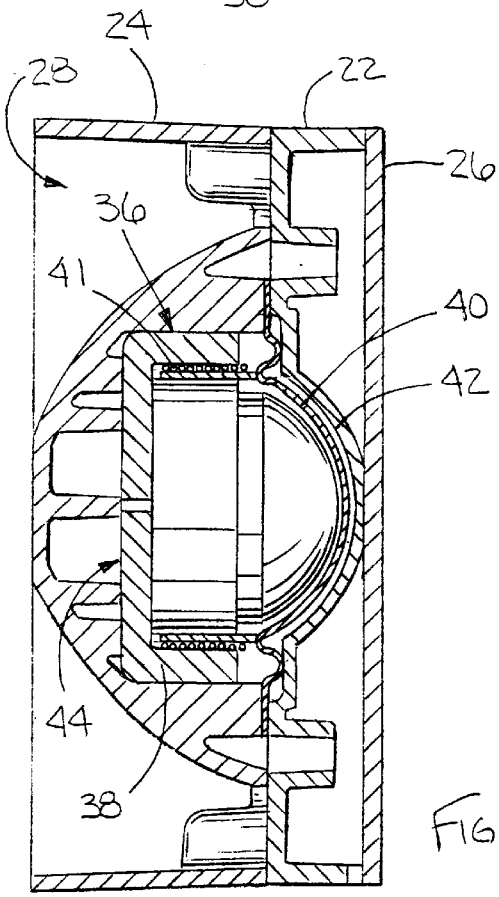
FIG. 3 is a cutaway view of the speaker of FIG. 1.

Turning to the cutaway view of FIG. 3, the motor circuit 36 includes a magnet assembly 38, a dome-shaped diaphragm 40, and a voice coil 41 on a former attached to the diaphragm. The diaphragm 40 is supported for vibrational motion along the longitudinal axis of the speaker. The voice coil 41 interacts with the magnet assembly 38 to drive the diaphragm 40 into vibration to generate acoustic energy. A phase plug 42 is spaced from the diaphragm 40 by a small gap which is commonly called a"front side compliance." The phase plug 42 cooperates with the vibrating diaphragm 40 to produce sound waves which are coupled by the horn structure of the speaker to the external air.

In the illustrated embodiment, the phase plug 42 is integrally formed on the horn plate 22 and has apertures formed therein. As will be described in greater detail below, each of the apertures leads to a folded horn in the horn plate 22 and forms the throat of the respective horn. Forming the phase plug for the motor circuit integrally on the horn plate results in a significant reduction of the overall length of the speaker 20.

A further length reduction results from receiving the motor circuit 36 in the mouth section 24 of the horn structure. As shown in FIG. 3, the magnet assembly 38 of the motor circuit 36 is received in a receptacle 44 which is integrally formed in the mouth section 24 of the speaker. As will be described in greater detail below, this integration of the motor circuit structure with the horn structure not only shortens the length of the speaker but also provides a very simple, precise, and robust means for mounting the motor circuit 36, and provides significant benefits in controlling the operating temperature of the motor circuit.

Figure 4A:
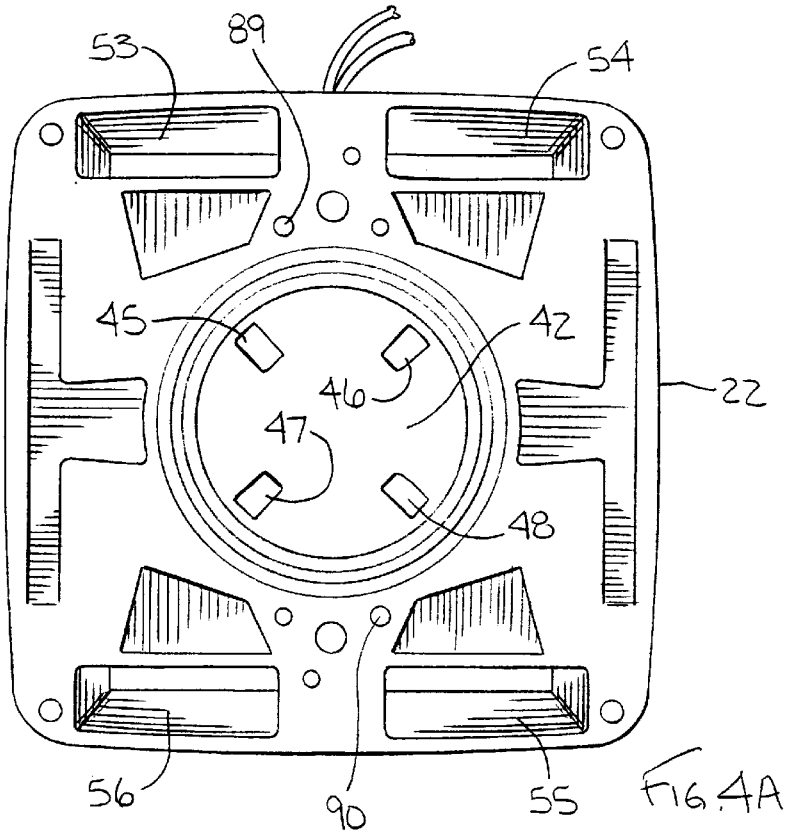
FIG. 4A is a front elevational view of a horn plate of the speaker of FIG. 1.
Figure 4B:
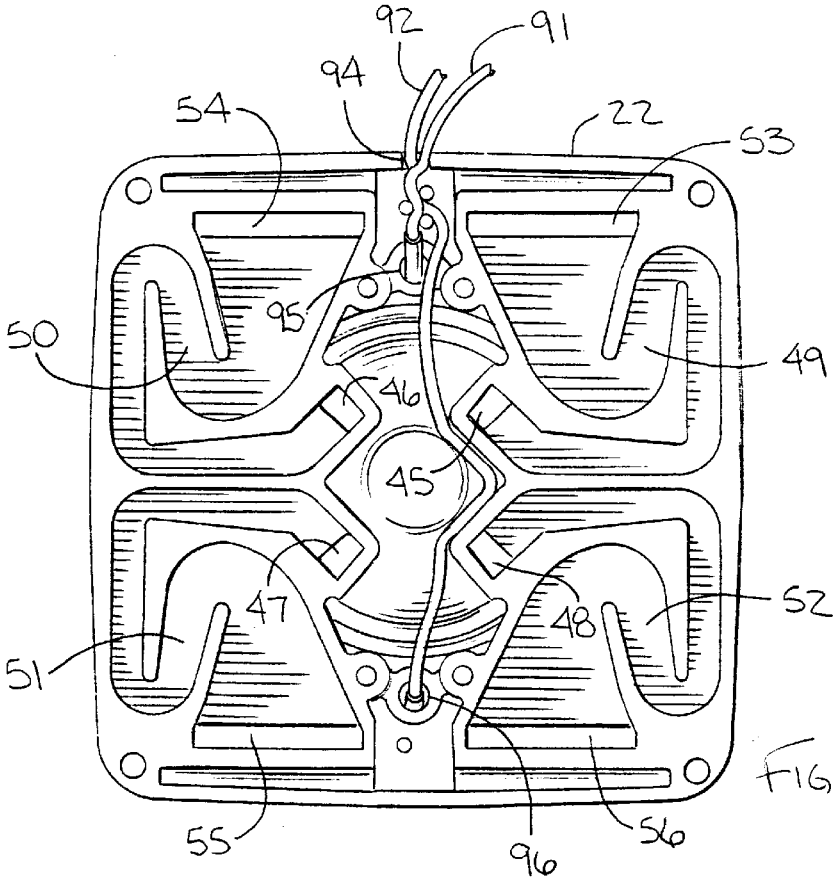
FIG. 4B is a rear elevational view of the horn plate of FIG. 4A.

The construction of the horn plate 22 can be best seen in FIGS. 4A and 4B. In the illustrated embodiment, the horn plate 22 has a thickness of about 0.75 inches. The horn plate 22 is preferably formed as a unitary piece which is preferably molded of aluminum. The center of the front side of the horn plate 22 as shown in FIG. 4A has an integrally formed concave surface which serves as the phase plug 42 of the motor circuit. The phase plug 42 has four apertures 45–48 formed therein. Each of the apertures 45–48 opens to a folded horn on the back side of the horn plate 22 shown in FIG. 4B. The front side of the horn plate 22 has two alignment pins 89 and 90 mounted thereon which are used to align the diaphragm 40 of the motor circuit and the mouth section 24 with respect to the horn plate 22.

As shown in FIG. 4B, the back side of the horn plate 22 has four folded horns 49–52 formed therein. By folding the horns in the plane of the horn plate 22 which is perpendicular to the longitudinal direction of the speaker, a significant horn length is achieved in a very small dimension in the longitudinal direction of the speaker. The apertures 45–48 in the phase plug 42 couples the acoustic energy generated by the motor circuit into the folded horns 49–52 and thus form the throats of the respective folded horns. The acoustic energy passed through the horns 49–52 is redirected in the forward direction of the speaker through four generally rectangular slots 53–56 on the front side of the horn plate.

Figure 4C:
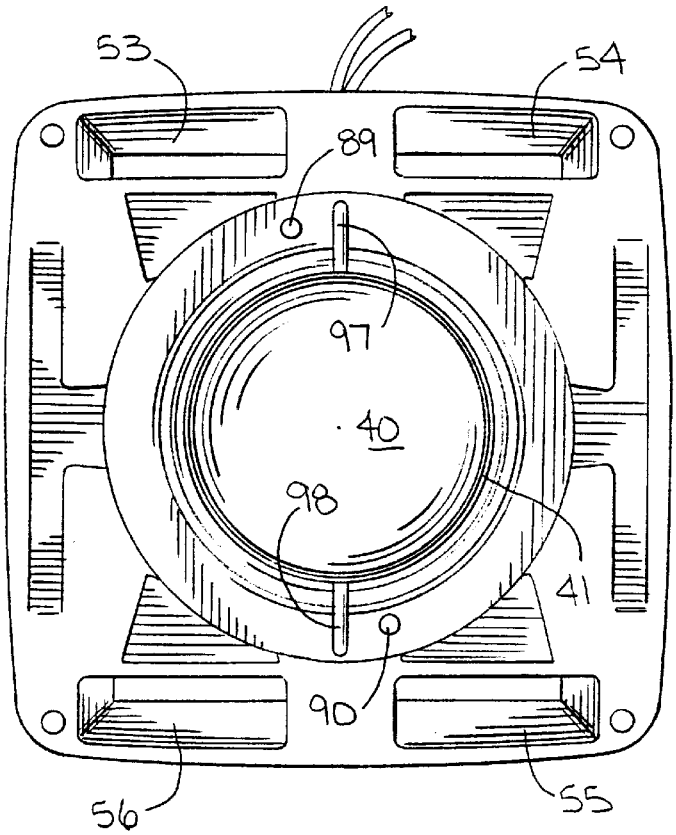
FIG. 4C is a front elevational view of the horn plate similar to FIG. 4A but with a sound-generating diaphragm attached thereto.

The electrical signal for operating the motor circuit is coupled to the motor circuit via two insulated electrical wires 91 and 92, which enter the speaker through an aperture 94 on the side of the horn plate. The wires are passed from the rear side of the horn plate 22 to its front side through two through-holes 95 and 96, respectively. FIG. 4C shows the diaphragm 40 of the motor circuit disposed on the front side of the horn plate 22. The ends of the wires 91 and 92 are soldered to conductive spring strips 97 and 98, respectively.

The conductive spring strips 97 and 98 are in turn connected to the ends of the voice coil 41 wound on a former attached to the diaphragm 40. The edge portion of the diaphragm 40 has two alignment holes formed therein which fit over the respective alignment pins 89, 90 on the horn plate 22 when the diaphragm 40 is installed in its operating position.

Figure 5A:
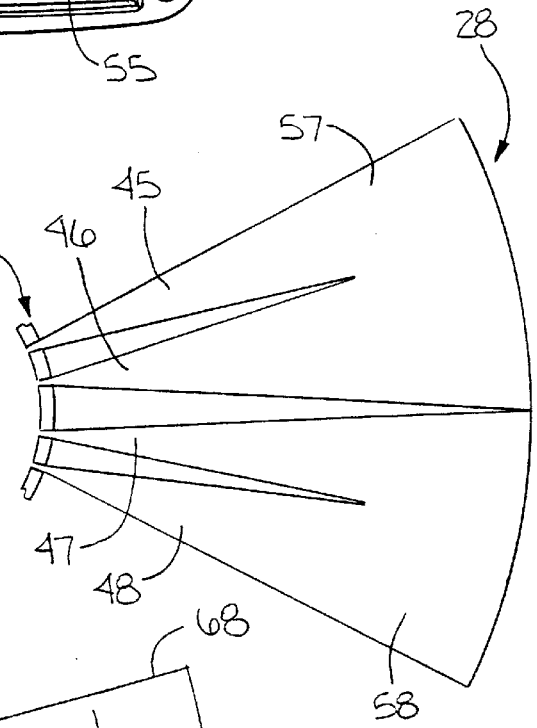
FIG. 5A is a schematic diagram illustrating a coupling of a motor circuit with multiple horns implemented in the horn plate of FIG. 4B.

It is a feature of the illustrated embodiment to couple the motor circuit directly at the phase plug 42 to a plurality of separate horns in the horn plate 22. This coupling is schematically illustrated in FIG. 5A, where the four horns 45–48 project directly from the phase plug 42. The acoustic waves pass through the four horns and are recombined at the horn mouth 28 for efficient coupling with external air. As shown in FIG. 1 and FIG. 5A, in the illustrated embodiment the two horn sections 57, 58 remain separated up to the end of the horn structure. The final recombination of the sound waves does not occur within the speaker but effectively happens in front of the speaker.

Figure 5B:
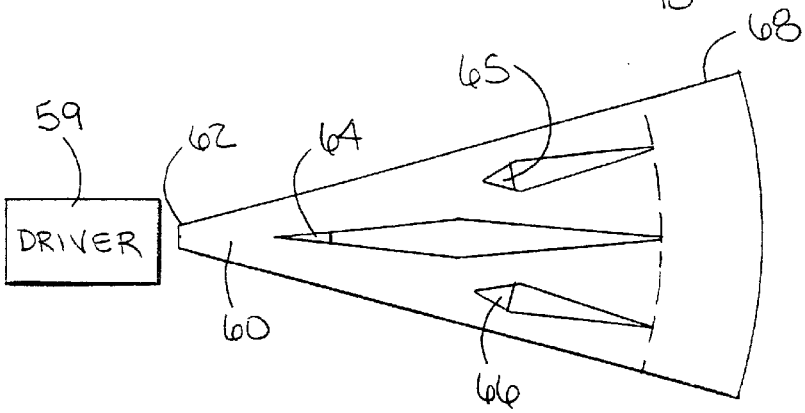
FIG. 5B is a schematic diagram illustrating a coupling of a motor circuit with a horn implemented in a prior art speaker.

By way of contrast, the driver-horn coupling implemented in the prior art speaker disclosed in U.S. Pat. No. 4,893,343 mentioned above is schematically illustrated in FIG. 5B. The acoustic energy generated by the motor circuit 59, which includes a phase plug (not shown), is coupled to a single horn 60 through a horn throat 62 which is separated from the motor circuit. The horn 60 is bifurcated twice, first by a diverting surface 64 and then by diverting surfaces 65 and 66, into four horn passages. The acoustic waves passed through the four horn passages are recombined at the horn mouth 68.

The construction of the mouth section 24 of the illustrated embodiment can be best seen in FIGS. 6A and 6B. The mouth section 24 has a unitary body 25 which is formed of a thermally conductive material. In the preferred embodiment, the unitary body is molded of aluminum and then machined to provide precise dimensions of pertinent features. The front side of the mouth section 24 is shown in FIG. 1. FIG. 6A shows the back side of the mouth section 24 with the magnet assembly 38 of the motor circuit received therein. FIG. 6B shows the mouth section 24 with the magnet assembly 38 removed therefrom. At the center of the rear side of the mouth section 24 is an integrally formed receptacle 44 for receiving the magnet assembly 38 of the motor circuit. In the illustrated embodiment, the receptacle 44 is in the form of a cylindrical recess. Adjacent the edges of the mouth section are four generally rectangular slots 71–74 positioned to match the four slots 45–48 on the front side of the horn plate 22. The mouth section has two alignment holes 101 and 102 which mates with the alignment pins 89, 90 on the horn plate 22 when the horn plate is fastened to the mouth section. The four slots 71–74 open to the horn mouth 28 formed on the front side of the mouth section as shown in FIG. 1. Thus, the acoustic energy generated by the motor circuit is conducted through the four folded horns in the horn plate 22 and then emerges at the horn mouth 28.

Besides the significant reduction of the overall length of the speaker of the invention, the integration of the structure of the motor circuit with the structure of the horn section provides: (1) an extremely simple, robust, and precise way to mount the motor circuit in the horn speaker, and (2) significantly improved thermal dissipation for the heat generated by the motor circuit. The receptacle 44 in the mouth section 24 holds the magnet assembly 38 firmly at a designed location in alignment with the other speaker components. By virtue of this simple mounting arrangement, the speaker has a very simple structure. In the illustrated embodiment, the speaker 20 has only five major separable pieces, namely the mouth section 24, the magnet assembly 38, the diaphragm 40, the horn plate 22, and the end plate 26. The integral formation of the phase plug 42 on the horn plate 22 avoids alignment errors introduced by the use of a separately inserted phase plug in front of the diaphragm. Because there is no adjustment required in assembling these pieces, the proper alignment between the diaphragm 40, the phase plug 42, and the horn structure for providing optimal performance is ensured.

It is a feature of the invention to mount the magnet assembly 38 in efficient thermal contact with a thermally conductive section of the horn structure. In the preferred embodiment, the receptacle 44 formed in the mouth section 24 is sized and shaped to match the magnet assembly 38 to provide efficient thermal transfer between the magnet assembly 38 and the mouth section. With this arrangement, the entire mouth section 24 becomes a heat sink for the motor circuit 36, and the air passing through the horn mouth contributes to the cooling of the motor circuit. In the preferred embodiment, the thermal conduction between the magnetic assembly 38 and the mouth section 24 is enhanced by forming the receptacle 44 to be very slightly smaller than the magnet assembly 38, and pushing the magnet assembly into the receptacle by a force of about 5000 pounds to form a firm metal-to-metal contact.

Figure 10:
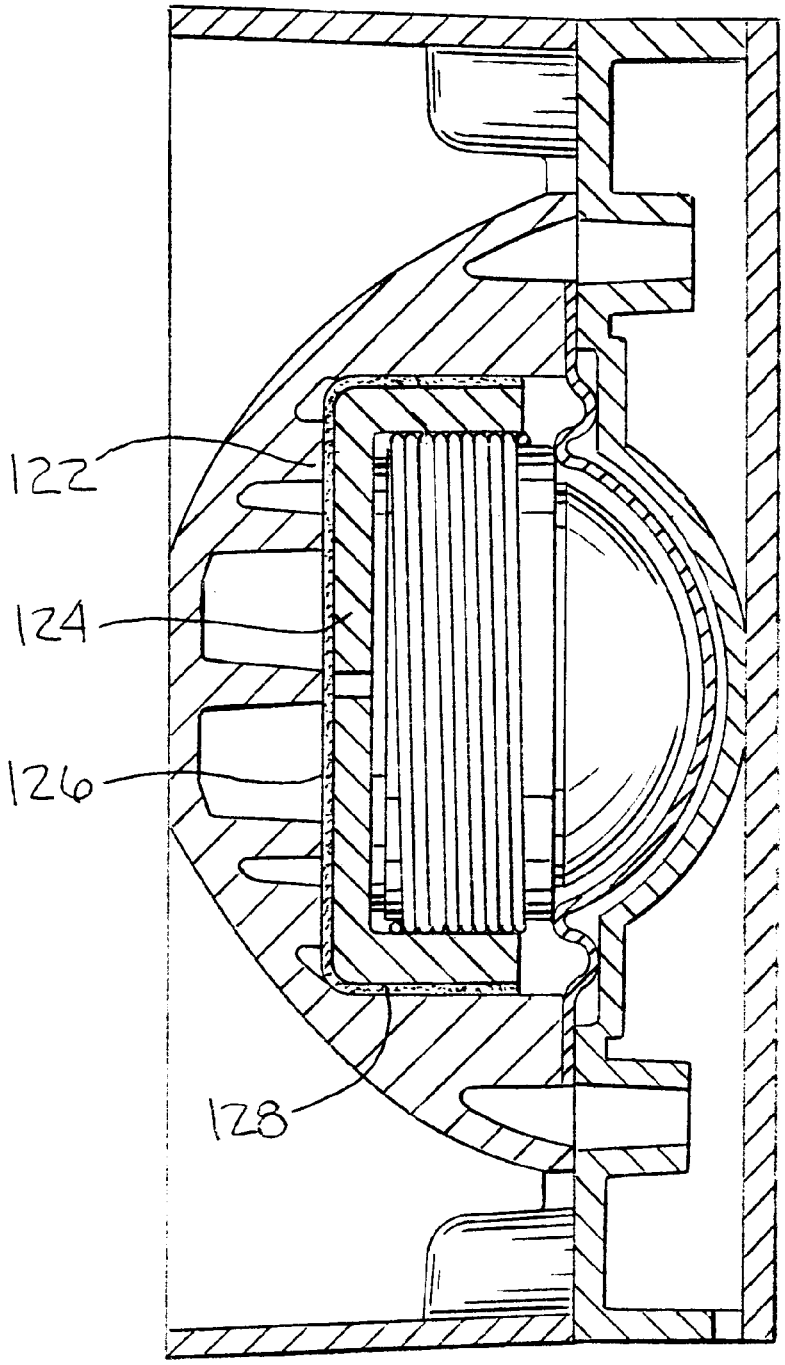
FIG. 10 is a cutaway view of an alternative embodiment of the horn speaker.

Alternatively, the receptacle may be formed to provide a snug fit or a slightly lose fit with the magnet assembly. As an example, a speaker with such an arrangement is shown in the cutaway view of FIG. 10. The mouth section 120 of the speaker has a receptacle 122 formed therein, and a magnet assembly 124 is received in the receptacle. Proper heat transfer between the magnet assembly 124 and the mouth section 120 is provided by filling a gap 126 between the magnet assembly and the receptacle with a thin layer 128 of thermally conductive adhesive. The adhesive layer 128 attaches the magnet assembly 124 firmly to the receptacle 122 and efficiently conducts heat generated in the motor circuit to the mouth section.

The efficient heat dissipation provided by the heat transfer between the motor circuit and the horn structure is especially important for controlling the operating temperature of the motor circuit. Inadequate heat sinking raises the temperature of the components of the motor circuit, resulting in a reduction of the sound generation efficiency of the speaker. In severe cases the heat can cause the voice coil 41 of the motor circuit to be burned out or cause the magnet assembly 38 to lose its magnetic strength. The significant differences in operating temperature of the motor circuit made by the efficient heat dissipation can be clearly seen in the measured operating temperature data shown in FIG. 7. The data points on the curve 80 show measured temperature data of the magnet assembly of a motor circuit installed in a speaker of FIG. 1. The data points on the curve 82 are measured temperature data for a bare motor circuit consisting of only a diaphragm with a voice coil and a magnet assembly. Temperature data of the ambient air are also shown on the curve 84 for reference. Both the full speaker and the bare motor circuit were operated at an input of 16 watts of electrical DC power for 45 minutes.

As shown in FIG. 7, the temperature of the motor circuit in the speaker rose slowly during operation and showed a trend of leveling off under 50° C. In sharp contrast, the temperature of the bare motor circuit, which did not have the efficient heat sinking provided by the mouth section, continued to increase rapidly during operation and was approaching 90° C. at the end of measurement. The data in FIG. 7 were taken with a DC input so that no sound waves were generated by the speaker. It will be appreciated that in field operation the high air velocity of sound waves at the horn mouth will contribute to the further reduction of the operation temperature of the motor circuit.

The compact size of the horn speaker of the invention provides significantly improved flexibility in the placement of the speaker. As a result, the speaker can be installed at places not possible with the much bulkier and heavier prior art siren speakers. For instance, as shown in FIG. 8, the small longitudinal dimension of the speaker 20 allows it to be installed in the relatively narrow space between the front body frame 104 in front of the radiator and the wind damper skirt 106 of a vehicle. The speaker may be mounted on a bracket secured to the front body frame. To that end, the speaker 20 has two mounting holes 111 (FIG. 1) formed on its sides for receiving fasteners. FIG. 9 shows, as an example, a mounting bracket 108 for mounting the speaker 20 in a given vehicle at the location illustrated in FIG. 8. It will be appreciated that different vehicles may require different configurations of mounting brackets.

As can be appreciated from the foregoing detailed description, the invention provides a horn speaker that is much more compact than existing horn-loaded siren speakers. The compact size of the speaker provides significantly improved flexibility in mounting the speaker on an emergency vehicle. The compactness is achieved by integrating the structure of the motor circuit with the horn structure. The integrated structure further results in a very simple construction that is robust, low in parts count, and easy to manufacture, and provides high efficiency in dissipating heat generated by the motor circuit during operation.

What is claimed is:

1. A compact horn speaker comprising:

a motor circuit having a dome-shaped movable diaphragm, a voice coil attached to the movable diaphragm, and a magnet assembly for interacting with the voice coil to move the movable diaphragm to generate acoustic energy;

a horn plate having a plurality of horns folded in a plane of the horn plate and an integrally formed concave phase plug spaced from the movable diaphragm, the phase plug having a plurality of apertures each opening to a respective one of the folded horns for passing acoustic energy into the respective folded horn;

a mouth section having a unitary body formed of a thermally conductive material and shaped into a horn mouth which is connected to the plurality of folded horns for coupling the acoustic energy to external air, the unitary body having an integrally formed receptacle for receiving the magnet assembly, the receptacle sized and shaped to match the magnet assembly to provide thermal contact for conducting heat generated by the motor circuit during operation to the mouth section.

2. A compact horn speaker as in claim 1, wherein the horn plate has four horns folded therein.

3. A compact horn speaker as in claim 2, wherein the horn plate is molded of aluminum.

4. A compact horn speaker as in claim 1, wherein the thermally conductive material forming the unitary body of the mouth section is aluminum.

5. A compact horn speaker as in claim 1, wherein the receptacle is sized to closely fit the magnet assembly to provide direct mechanical and thermal contact between the magnet assembly and the mouth section.

6. A compact horn speaker as in claim 1, wherein the magnet assembly is firmly attached to the receptacle by thermally conductive adhesive for transferring heat generated by the motor assembly during operation to the mouth section.

* * * * *